US006175068B1

(12) United States Patent
Belli

(10) Patent No.: US 6,175,068 B1
(45) Date of Patent: Jan. 16, 2001

(54) DRUMHEAD

(75) Inventor: Remo D. Belli, Valencia, CA (US)

(73) Assignee: Remo, Inc., A California Corporation, Valencia, CA (US)

( * ) Notice: Under 35 U.S.C. 154(b), the term of this patent shall be extended for 0 days.

(21) Appl. No.: 09/135,424

(22) Filed: Aug. 17, 1998

Related U.S. Application Data

(63) Continuation-in-part of application No. 08/848,216, filed on Apr. 29, 1997.

(51) Int. Cl.[7] ..... G10D 13/02
(52) U.S. Cl. ..... 84/414; 84/411 R; 84/411 P
(58) Field of Search ..... 84/411 R, 411 P, 84/414; 428/540, 596

(56) References Cited

U.S. PATENT DOCUMENTS 3,626,458 * 12/1971 Zickos ..... 84/411
4,282,793 * 8/1981 Muchnick ..... 84/414
5,429,108 * 7/1995 Hsieh ..... 125/65
5,581,044 * 12/1996 Belli et al. ..... 84/414
5,864,077 * 1/1999 Gatzen ..... 84/414

* cited by examiner

*Primary Examiner*—Robert E. Nappi
*Assistant Examiner*—Kim Lockett
(74) *Attorney, Agent, or Firm*—Rapkin & Gitlin; Larry F. Gitlin, Esq.

(57) ABSTRACT

A head of a drum or similar kind of musical instrument comprising a synthetic plastic sheet material containing surfaces with variegated color shadings to give the texture and appearance of a natural animal skin. A method of manufacture of the improved drumhead including the steps of fine sanding to produce minor surface scratches, and intensive sanding to produce deeper scoring or gouges in the top and bottom surfaces of the head. A coating of resin is applied to the surfaces and collects within the scratched and gouged areas to produce the variegated characteristics of a natural skin and manipulate the surface structure to provide vastly improved sound.

18 Claims, 1 Drawing Sheet

FIG. 1
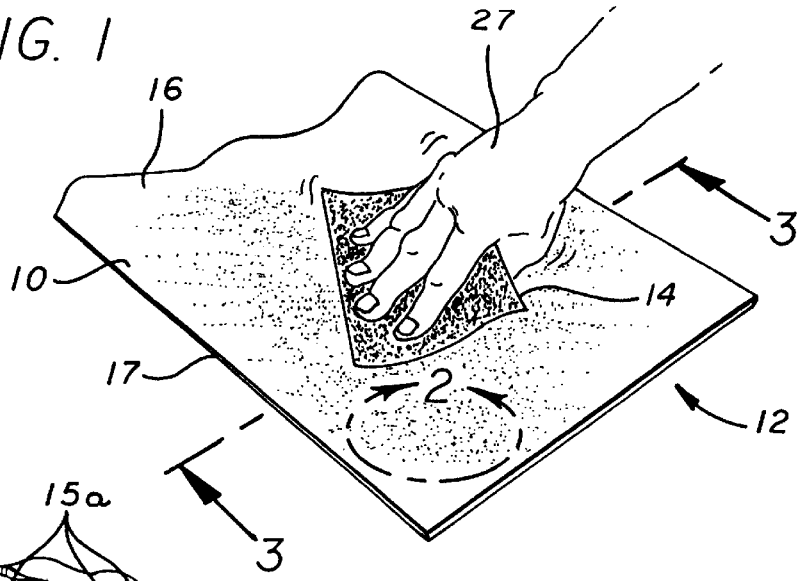
FIG. 2
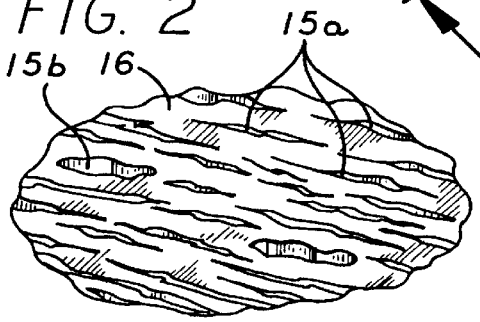
FIG. 3
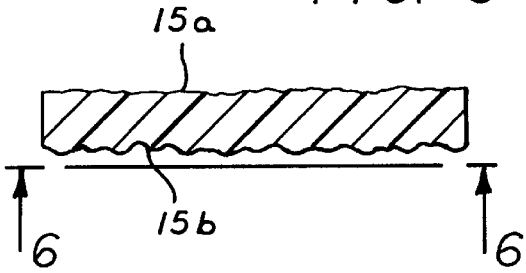
FIG. 4
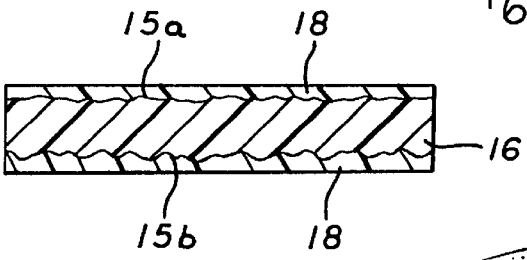
FIG. 5
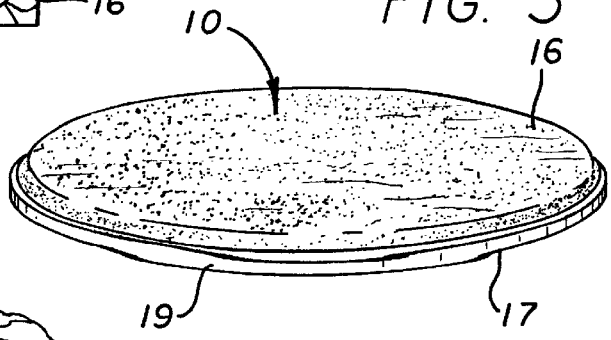
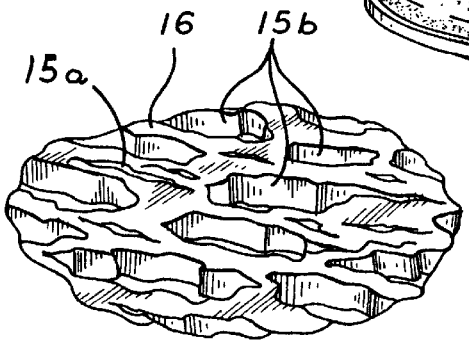
FIG. 6

DRUMHEAD

This application is a continuation in part of Ser. No. 08/848,216, filed Apr. 29, 1997.

BACKGROUND OF THE INVENTION

1. Field of the Invention

The present invention relates generally to drums and similar musical instruments and, more particularly, to a head for a drum and a method for improving the sound and appearance of the drumhead.

2. Description of the Prior Art

Drumheads of various types and materials are well-known in the prior art. U.S. Pat. No. 4,308,782 to Harty contains an informative discussion on the subject. U.S. Pat. Nos. 5,091,248 and 5,581,044 to Belli are also pertinent to the technology.

Laminated drumheads, which are comprised generally of adhesively bonded sheets of synthetic fabric and plastic materials, are employed largely in conjunction with tom-toms and snares. Rarely are laminated heads used to produce a timpani drum, which is used primarily in an orchestral setting often joined by over one hundred other string, wind and percussion instruments. The laminate head simply does not produce the degree and quality of resonance and warm, rich and full sound required of a drum of this type in a symphonic setting.

Timpani heads are usually comprised either of a single plastic sheet material, such as MYLAR®, or ideally of a natural animal skin. A timpani head must vibrate sufficiently to produce the quality and volume of sound required to be an effective percussion instrument in a large orchestra. Plastic heads have their drawbacks as they do not resonate sufficiently or produce a full enough sound to perform at optimum levels in an orchestral setting. These heads are not susceptible to proper pitch control and consistently suffer from sound decay. They also have a characteristic plastic or "clicking" sound that many musicians, particularly timpanists, find distracting and unappealing. Laminate drumheads, principally because of the nature and complexity of their double layered construction, simply do not vibrate or resonate adequately enough to produce the desired timpani sound. They act as a poor substitute for a natural animal skin head.

Plastic drumheads may also include slightly roughened surfaces. But these surfaces constitute only mere umperfections in the material. These slight projections and depressions, when they appear, are inherent in the material and are not placed there intentionally for the purpose of achieving a specific look or sound.

In the rare instance where a drumhead surface is intentionally given some degree of texture, it occurs for the sole purpose of enabling the drummer to produce a shuffling or scratchy sound as the drumstick or brush is made to move along the head surface. Improved sound quality or appearance, such as a more natural look, is not the objective in these instances.

Absolutely nothing in the prior art has succeeded in creating a synthetic head to ideally match the sound qualities and appearance of a natural skin. Animal skins produce a more sophisticated, resonant sound, particularly in the lower ranges, which drummers of all disciplines generally prefer. The sounds are rich and warm and decidedly focused and the pitch is more centered. Pitch control is much easier with drumheads fashioned from animal skin. However, animal skins are much more costly than synthetic heads. Skins also have a tendency to absorb moisture, which can have a dramatically negative effect on the quality of the sound and the pitch produced by the drumhead. Depending on the climate, the humidity condition(s) and the extent of any moisture absorbed by the head, the sound generated by a head comprised of natural skin will differ from one location to another, often substantially.

The present invention solves the foregoing problems in the prior art by employing a relatively less expensive head comprised of only a single sheet of plastic material, which is fashioned carefully to produce a head that has the look and sound of a head made from a genuine skin. The plastic sheet material employed by the present invention is roughened up on both sides with various grits of sandpaper or emery cloth to control the depth and breadth of the texture and then coated with a resin. The resin coats the surfaces of the head and collects in the scratched and gouged areas produced by the sanding process. The areas where the resin collects tend to produce shades with varying intensity, giving the head the characteristics and appearance of an authentic skin. The improved head produces more resonance and has significantly more overtones than anything preceding it in the prior art. It also has the appearance of a genuine animal skin without any of the major disadvantages. A method of manufacture of the improved drumhead is also provided.

SUMMARY OF THE INVENTION

The improvement of the present invention provides a head of a drum or a similar kind of musical instrument comprising a synthetic plastic sheet material, which contain s a surface with variegated color shadings to give the texture, character and appearance of a natural animal skin. The diverse shading effect is achieved through a process of sanding or roughing up the head surface with an emery cloth or any other suitable sandpaper—like material. Fine sanding generally produces minor surface scratches, while a more intense sanding using more pressure and a coarser grade of cloth or paper will produce deeper scoring or gouges in the surfaces of the head. A coating of resin, preferably epoxy or acryllic, is applied to the surface and collects in a more concentrated fashion within the scratched and gouged areas of the surface. The deeper and/or wider the scratch or gouge, the more resin is collected and the darker the shading in that particular area or spot. It is these specific shading variations of the drumhead surface that give the head the characteristic look of a natural animal skin. It is the distortion of the head, brought about by this specific manipulation of its structure, that gives the head the improved sounds that are more resonant, fuller and richer, with more overtones and pitch control, than the synthetic heads in the prior art. The present invention also provides a method of manufacture of the improved drumhead, including the steps of embellishing the top and bottom surfaces of a sheet of synthetic material comprising the head by forming a plurality of scratches and gouges, which vary in size and depth, and applying a resin to the surfaces to coat them and fill in the various depressed areas to achieve generally flat and even surfaces with the overall realistic appearance and sound of a natural animal skin.

Accordingly, an object of the present invention is to provide a synthetic drumhead that has the appearance of a natural animal skin.

Another object of the present invention is to provide a synthetic drumhead that contains the more sophisticated sound producing qualities of a natural animal skin.

A further object of the present invention is to provide a single sheet of plastic material comprising a drumhead with the appearance and sound qualities of a natural animal skin.

Still another object of the present invention is to provide a synthetic drumhead which enables the improvement of the tonal, tactile and visual qualities of the drumhead.

Still another object of the present invention is to provide a synthetic drumhead that is easy, efficient and relatively inexpensive to manufacture.

Still another object of the present invention is to provide a method of manufacture of the drumhead of the present invention.

Still another object of the present invention is to provide a method of manufacture of a drumhead from a single sheet of synthetic material that has the appearance and sound producing qualities of a natural animal skin without the usual drawbacks of a genuine skin.

Other objects and advantages of the present invention will become apparent in the following specifications when considered in light of the attached drawings wherein the preferred embodiment of the invention is illustrated.

BRIEF DESCRIPTION OF THE DRAWINGS

FIG. 1 is a perspective view of the present invention shown in the process of being sanded.

FIG. 2 is a perspective sectional view of the present invention showing more prominently in highly magnified form the textured surface areas produced by the sanding process using a relatively fine grade of emery cloth or sandpaper.

FIG. 3 is a cross-sectioned view of the present invention depicting the top surface of the plastic material after sanding with a relatively fine grade of paper and the bottom surface of the material after sanding with a coarser grade of paper.

FIG. 4 is a cross-sectional view of the present invention showing the resin-coated surface and the resin collected in various amounts within the top and bottom textured surfaces of the material.

FIG. 5 is a perspective view of the improved drumhead of the present invention attached to and framed within a counterhoop.

FIG. 6 is a perspective view of the present invention shown along lines 6—6 of FIG. 3.

DETAILED DESCRIPTION OF THE PREFERRED EMBODIMENT

Referring more particularly to the drawings, FIG. 1 is a perspective view of the present invention comprised initially of a single sheet of material 12 made of plastic, such as MYLAR®, from which a drumhead 10 is formed. Sheet material 12 includes various scratched 15*a* or gouged 15*b* sections 15 formed within the surfaces 16, 17. These roughened areas of surfaces 16, 17 are produced using different grades of emery cloth 14 or some other suitable material for sanding, such as, for example, actual sand paper. Surfaces 16, 17 are initially sanded with a fine grit of emery cloth 14, for example a grit measured at 320 microns. If appropriate and desirable, a more coarse grit of emery cloth, for example 60 microns can be used to form a series of deeper scratches or gouges in the material. For standard drumheads where the darkness of the shade is not as significant the top surface 16 and bottom surface 17 are normally sanded using only a finer grade of cloth or paper such as, for example, a 320 micron grit.

Generally, a coarse cloth or sandpaper will create a deeper penetration into the surface of the plastic and, consequently risk a weakening of the material. Thus, in order to achieve the desired level of shading within the head surface and maintain sufficient strength in the material, different grits of cloth or sand paper may be employed on the top and bottom surfaces. Thus, for timpani heads, where color shadings, particularly darker tones, are more desirable to give a richer and even more natural skin appearance, a 320 micron grit paper may be employed to sand the top surface 16 of the head and a coarser 60 micron grit paper may be employed to sand the bottom surface 17.

Epoxy resin 18 or any other similarly suited material, such as an acryllic, is applied as a coating on surfaces 16, 17 and collects within the scratched and gouged areas 15 in a manner that results in a diverse pattern of color shadings. Shallow scratches collect less resin and, thus, tend to look lighter in shade as more light is allowed to pass through them. In contrast, deeper scratches or gouges tend to collect more resin and, thus, appear darker shade. The resin that coats the surface of the head is the lightest of the three. Resin collected within the sanded areas of the surface gives the appearance of natural imperfection, creating a variety of contrasting characteristics and shades relative to each other and to the resin coating the surface. Thus, the variegated look of the drumhead simulates the appearance of a natural animal skin.

Various thicknesses of plastic sheet material may be employed with the present invention. Thinner sheets of material tend to be more transparent. Medium thicknesses tend to be more translucent. Thicker sheets are more opaque.

The method of the present invention includes the steps of sanding a sheet of plastic material 12, such as MYLAR®, using various grits of emery cloth 14 or some other suitable sanding material. The sanding is achieved by machine (not shown) or by hand 27. Initially, the surfaces 16, 17 are lightly sanded over their entirety. Delicate sanding creates a slightly uneven head surface. This rough or textured condition interrupts surface tension in the material to produce a better overall vibration and sound from the drum. A coarser version of cloth 14 may be used to create a rougher and more highly textured surface 17. Resin 18 is employed to coat the top surface 16 and the bottom surface 17. The resin is then allowed to cure. A counterhoop 19 is attached to give the head 10 strength, tension and form.

In applying the resin 18 to the surfaces 16, 17 using the method of the present invention, different amounts of the resin tend to collect in the scratched and gouged areas depending upon the width of the area formed and the depth of the particular depression. Shallow scratches and gouges collect less resin and, thus, are lighter in their appearance giving them a greater degree of transparency. Deeper scratches and gouges tend to collect more resin and, thus, are darker in their appearance and more opaque. The overall effect, including the diverse pattern of shadings, interspersed over and within the textured surfaces 16, 17 of the head 10, gives the characteristic appearance of a natural animal skin.

As with natural skin, drumhead 10 emboding the present invention is more susceptible to a controlled pitch. The head vibrates in a manner similar to a natural skin and creates a similar rich, warm and resonating sound. It also engenders a similar degree of overtones. The plastic heads employed in the prior art lack these characteristics and abilities and fail to produce the sophisticated kind of full sound necessary to compliment and compete with the quality and level of sounds produced by a symphonic orchestra.

The present invention can be employed as a timpani head in combination with a large kettle drum of the type that performs with a symphony orchestra. Drumhead 10 can also be used with tom-toms, snares, a bass and virtually any other type of musical drum played in a band or an orchestra.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A head for a drum or similar musical instrument comprising a synthetic sheet material having a contact surface and a bottom surface, and a plurality of depressed areas; in said contact surface that do not penetrate through to the bottom surface and a plurality of depressed areas in said bottom surface that do not penetrate through to the contact surface creating uneven areas of said surfaces, and a resin coating on said surfaces, said resin coating being applied to fill said depressed areas and cover said surfaces to form generally flat and even surfaces and variegated areas integrally related therewith, said variegated areas possessing diverse light transmissive capabilities according to the amount and thickness of said resin in said depressed areas to give the drumhead the appearance of a natural animal skin.

2. The invention of claim 1 wherein said synthetic sheet material is plastic.

3. The invention of claim 1 wherein said synthetic sheet material is transparent.

4. The invention of claim 1 wherein said synthetic sheet material is translucent.

5. The invention of claim 1 wherein said synthetic sheet material is opaque.

6. The invention of claim 1 wherein said depressed areas comprise a plurality of scratches.

7. The invention of claim 1 wherein said depressed areas comprise a plurality of gouges.

8. The invention of claim 1 wherein said depressed areas comprise a plurality of scratches and gouges.

9. The invention of claim 1 wherein said resin coating comprises epoxy.

10. The invention of claim 1 wherein said resin coating comprises acrylic.

11. The invention of claim 1 wherein said resin filled depressed areas are darker in appearance than the resin coated generally flat and even areas of said surfaces.

12. A method of manufacture of a drumhead comprising the steps of:

a. sanding a sheet of synthetic material having a contact surface and a bottom surface to form a plurality of uneven depressed areas within said surfaces comprising a plurality of scratches and gouges which when formed do not penetrate from one said surface to the other said surface; and, b. applying a resin coating upon said top and bottom surfaces to fill said scratches and gouges to form said surfaces that are generally flat and even incorporating variegated areas of light and dark shades which vary according to the amount and thickness of said resin coating in said scratches and gouges.

13. The method of manufacture of claim 12 wherein said synthetic material comprises plastic.

14. The method of manufacture of claim 12 wherein said resin coating comprises an epoxy compound.

15. The method of manufacture of claim 12 including the step of attaching a counterhoop to said sheet of synthetic material to provide tension and give a generally circular shape to the drumhead.

16. A method of manufacture of a drumhead comprising the steps of:

a. forming a plurality of depressed areas in the top and bottom surfaces of a sheet of synthetic material such that said depressed areas do not penetrate from one said surface to the other said surface; and, b. applying a resin coating upon said top and bottom surfaces to coat said surfaces and fill the depressed areas therein to achieve generally flat and even said surfaces and variegated areas of light and dark shades, which vary according to the amount and thickness of said resin coating in said depressed areas to give the drumhead the appearance of a natural animal skin.

17. A head for a drum or similar musical instrument comprising a synthetic sheet material having a contact surface and a bottom surface, and a plurality of depressions in said contact surface and said bottom surface formed to create an uneven surface area within said surfaces, said plurality of depressions comprising a variety of scratches and gouges that differ in depth and width, and, when formed, do not penetrate from one said surface to the other said surface, a resin coating being applied in varying thicknesses to fill said depressions and cover said contact and bottom surfaces to vary the intensity of the shades to simulate the appearance of a natural animal skin and improve the resonance character and quality of the drum sounds.

18. A head for a drum or similar musical instrument comprising a synthetic sheet material having a contact surface and a bottom surface, and a plurality of depressions in said contact surface and said bottom surface to create an uneven surface area, said plurality of depressions comprising a variety of scratches and gouges that vary in depth and width, and that, when formed, do not penetrate from one said surface to the other said surface, and a resin coating being applied, whereby the areas with the deeper configured depressions can accommodate relatively larger amounts of resin material to become relatively less light transmissive and disposed to appear more dark in shade and the areas with a relatively shallow configuration can accommodate smaller amounts of resin to become relatively more light transmissive and disposed to appear more light in shade, said combination of light and dark shades defined within said varying configurations having the appearance of a drumhead comprised of natural animal skin.

* * * * *